US008808037B2

(12) United States Patent
Park

(10) Patent No.: US 8,808,037 B2
(45) Date of Patent: Aug. 19, 2014

(54) SLIDABLE POGO PIN

(75) Inventor: Sangyang Park, Chungcheongbuk-do (KR)

(73) Assignee: Iwin Co., Ltd., Cheonan-Si, Chungcheongnam-Do ( * ) Notice: Subject to any disclaimer, the term of this patent is extended or adjusted under 35 U.S.C. 154(b) by 267 days.

(21) Appl. No.: 13/500,727

(22) PCT Filed: Aug. 9, 2010

(86) PCT No.: PCT/KR2010/005192
§ 371 (c)(1),
(2), (4) Date: Apr. 6, 2012

(87) PCT Pub. No.: WO2011/046290
PCT Pub. Date: Apr. 21, 2011

(65) Prior Publication Data

US 2012/0202390 A1 Aug. 9, 2012

(30) Foreign Application Priority Data

Oct. 12, 2009 (KR) ..... 10-2009-0096525
Mar. 2, 2010 (KR) ..... 10-2010-0018661
Apr. 8, 2010 (KR) ..... 10-2010-0032454
May 15, 2010 (KR) ..... 10-2010-0045703

(51) Int. Cl.
*H01R 13/24* (2006.01)
*H01R 12/71* (2011.01)
*H01R 12/73* (2011.01)

(52) U.S. Cl.
CPC ..... *H01R 12/73* (2013.01); *H01R 2201/20* (2013.01); *H01R 12/714* (2013.01); *H01R 13/2435* (2013.01); *H01R 13/2421* (2013.01)
USPC ..... 439/700; 439/66

(58) Field of Classification Search
USPC ..... 439/66, 700
See application file for complete search history.

(56) References Cited

U.S. PATENT DOCUMENTS 7,025,602 B1 * 4/2006 Hwang ..... 439/66
7,467,952 B2 * 12/2008 Hsiao et al. ..... 439/66

(Continued)

FOREIGN PATENT DOCUMENTS

KR 10-2005-0017759 2/2005
KR 10-2005-0087300 8/2005

(Continued)

OTHER PUBLICATIONS

Korean Notice of Submission of Opinion for 10-2010-0127715 dated Feb. 21, 2012.

(Continued)

*Primary Examiner* — James Harvey
(74) *Attorney, Agent, or Firm* — Lowe Hauptman & Ham, LLP

(57) ABSTRACT

There is provided a slidable pogo pin including: a first member including a first body and a first connection portion extending from the first body and integrally formed with the first body; a second member including a second body and a second connection portion extending from the second body and integrally formed with the second body; and a spring applying elastic force to the first member and the second member, with at least a part of the first member and at least a part of the second member inserted into the spring. Further, the first member and the second member are electrically connected to each other via the first connection portion and the second connection portion, and the first connection portion and the second connection portion are configured to slide with respect to each other while the first connection portion is brought into surface-to-surface contact with the second connection portion.

19 Claims, 16 Drawing Sheets

(56) References Cited

U.S. PATENT DOCUMENTS

| | | | | |
|---|---|---|---|---|
| 7,520,754 | B1 * | 4/2009 | Gattuso | 439/66 |
| 7,559,769 | B2 * | 7/2009 | Hsiao et al. | 439/66 |
| 7,789,671 | B2 * | 9/2010 | Hsieh et al. | 439/66 |
| 7,815,440 | B2 * | 10/2010 | Hsieh et al. | 439/66 |
| 7,841,864 | B2 * | 11/2010 | Hsiao et al. | 439/66 |
| 7,845,988 | B2 * | 12/2010 | Hsiao et al. | 439/700 |
| 8,052,491 | B2 * | 11/2011 | Lin | 439/786 |
| 8,547,128 | B1 * | 10/2013 | Sochor | 324/755.05 |
| 2012/0202390 | A1 * | 8/2012 | Park | 439/700 |
| 2012/0238136 | A1 * | 9/2012 | Hwang | 439/607.01 |

FOREIGN PATENT DOCUMENTS

| | | |
|---|---|---|
| KR | 10-2008-0015512 | 2/2008 |
| KR | 10-2008-0037833 | 5/2008 |
| KR | 10-2008-0056978 | 6/2008 |
| KR | 20-2009-0008319 | 8/2009 |
| KR | 20-2009-0008320 | 8/2009 |

OTHER PUBLICATIONS

International Search Report mailed Apr. 20, 2011 for PCT/KR2010/005192.

* cited by examiner

--Prior Art--

--Prior Art--

(a)

(b)

SLIDABLE POGO PIN

CROSS REFERENCE TO RELATED APPLICATION

This application claims the priority of Korean Patent Application No. 10-2009-0096525, filed on Oct. 12, 2009, Korean Patent Application No. 10-2010-0018661, filed on Mar. 2, 2010, Korean Patent Application No. 10-2010-0032454, filed on Apr. 8, 2010, and Korean Patent Application No. 10-2010-0045703, filed on May 15, 2010 in the KIPO (Korean Intellectual Property Office). Further, this application is the National Phase application of International Application No. PCT/KR2010/005192 filed Aug. 9, 2010, which designates the United States and was published in Korean.

TECHNICAL FIELD

The present invention relates to a slidable pogo pin. More particularly, the present invention relates to a pogo pin that is used to transmit electric signals between electronic components in semiconductor wafers, LCD modules, semiconductor packages, a variety of sockets and the like.

BACKGROUND ART

A spring probe pin, commonly referred to as a pogo pin, is widely used for an inspection device for a semiconductor wafer, an LCD module and a semiconductor package, and for any kind of socket, a battery connector of a mobile phone, and the like.

FIG. 1 is a cross-sectional view of a related pogo pin.

Referring to FIG. 1, a pogo pin 10 includes an upper probe 12, a lower probe 14, a spring 16 for applying elastic force to the upper and lower probes 12, 14, and a cylindrical body 18 for receiving a lower end of the upper probe 12, an upper end of the lower probe 14 and the spring 16.

Each of the upper and lower probes 12, 14 is engaged at one end thereof by the cylindrical body 18 so that the upper and lower probes 12, 14 may be prevented from being escaped from the cylindrical body 18. The spring 16 is configured to apply elastic force to each of the upper and lower probes 12, 14.

FIG. 2 is a cross-sectional view illustrating a socket for inspection of a semiconductor package, in which a plurality of pogo pins is received in a dielectric body.

In FIG. 2, a socket 30 for inspection of a semiconductor package includes a plurality of pogo pins 10 and a dielectric body 20 which receives the plurality of pogo pins 10 separated a predetermined distance from each other.

The pogo pins 10 are received within the dielectric body 20 such that upper probes 12 protrude from an upper surface of the dielectric body 20 and lower probes 14 protrude from a lower surface of the dielectric body 20. The pogo pins 10 are arranged in the dielectric body 20 at the same intervals as those between external terminals 4 of a semiconductor package 2 which are brought into contact with the upper probes 12. The lower probes 14 are arranged at the same intervals as those of contact pads 8 of a test board 6 which is placed below the socket 30.

For inspection of the semiconductor package 2, the test board 6 is placed below the socket 30 and the semiconductor package 2 is placed above the socket 30. When the semiconductor package 2 is compressed, the external terminals 4 of the semiconductor package 2 are brought into contact with the upper probes 12 of the pogo pins 10, and the lower probes 14 are brought into contact with the contact pads 8 of the test board 6. The upper and lower probes 12, 16 are elastically supported towards upper and lower portions of the dielectric body 20 by the spring 16 in the pogo pin 10, respectively, so that the pogo pins 10 may electrically connect the semiconductor package 2 and the test board 6 to each other.

However, due to the reduced size, increased integration density and higher performance of the semiconductor package, the pogo pin for inspection of the semiconductor package has to be reduced in size accordingly and the socket for inspection of the semiconductor package using the pogo pin 10 also has to be reduced in size. In particular, the outer diameter of the pogo pin 10 has to be decreased according to a reduced distance between the external terminals of the semiconductor package 2.

Further, for the higher performance of the semiconductor package, the loss and distortion of an electric signal has to be minimized during transmission of the electric signal between the semiconductor package and the test board. In this case, the transmission path has to be in stable condition and the impedance of the transmission path has to be minimized.

However, a typical pogo pin is hardly likely to meet such requirements. For example, the transmission path may increase by the number of turns of the spring 14. Further, a great deal of undesired impedance may be created since the spring 14 exhibits relatively unsatisfactory electrical characteristics. Hence, the spring 14 is not suitable for the transmission path for the electric signal.

Accordingly, the pogo pin 10 transmits the electric signal through a transmission path passing through the upper probe 12, the cylindrical body 18 and the lower probe 14. However, the transmission path passing through the cylindrical body 18 may cause the following problem.

The upper and lower probes 12, 14 have to be smoothly vertically moved within the cylindrical body 18. In this case, the upper and lower probes 12, 14 received within the cylindrical body 18 have to have a smaller outer diameter than the cylindrical body 18. The cylindrical body 18 may be brought into too close contact with the upper and lower probes 12, 14, thereby causing increased contact resistance. In this case, the electric signal may be damaged or distorted in the transmission path. This may be serious when the electric signal has to be transmitted at high speed.

DISCLOSURE

Technical Problem

In view of the foregoing problems, the present invention provides a pogo pin that may minimize loss and distortion of electric signals transmitted between electronic components in semiconductor wafers, LCD modules, semiconductor packages, a variety of sockets, or the like.

Technical Solution

In accordance with one aspect, there is provided a pogo pin including: a first member including a first body and a first connection portion extending from the first body and integrally formed with the first body; a second member including a second body and a second connection portion extending from the second body and integrally formed with the second body; and a spring applying elastic force to the first member and the second member, with at least a part of the first member and at least a part of the second member inserted into the spring. Further, the first member and the second member are electrically connected to each other via the first connection portion and the second connection portion, and the first connection portion and the second connection portion are configured to slide with respect to each other while the first connection portion is brought into surface-to-surface contact with the second connection portion.

In accordance with another aspect, there is provided a pogo pin including: a first member including a first body, and a first middle connection bridge and at least one first side connection bridge each longitudinally extending from the first body; and a second member including a second body, and a second middle connection bridge and at least one second side connection bridge each longitudinally extending from the second body. Further, the first member and the second member are configured to slide with respect to each other while the first middle connection bridge is placed between the at least on second side connection bridge, and the second middle connection bridge is placed between the at least one first side connection bridge.

In accordance with a further aspect, there is provided an electrical connection pin including: a first connection bridge longitudinally extending from a first body and having a first sliding surface facing a first direction; a second connection bridge longitudinally extending from the first body and having a second sliding surface facing an opposite direction to the first direction; a third connection bridge longitudinally extending from a second body and having a third sliding surface facing a second direction; and a fourth connection bridge longitudinally extending from the second body and having a fourth sliding surface facing an opposite direction to the second direction. Further, the first body, the first connection bridge and the second connection bridge are integrally formed with each other; the second body, the third connection bridge and the fourth connection bridge are integrally formed with each other; and the first connection bridge and the third connection bridge are configured to slide with respect to each other and the second connection bridge and the fourth connection bridge are configured to slide with respect to each other, while the first sliding surface of the first connection bridge is brought into contact with the third sliding surface of the third connection bridge, and the second sliding surface of the second connection bridge is brought into contact with the fourth sliding surface of the fourth connection bridge.

In accordance with still another aspect, there is provided a pogo pin including: a first member formed of a straight line-shaped plate; a second member having two rectangular cross-sectional lead parts formed at one end of thereof and electrically connected to the first member via the two rectangular cross-sectional lead parts; and a spring applying elastic force to the first member and the second member, with at least a part of the first member and at least a part of the second member inserted into the spring. Further, the first member is configured to slide between the rectangular cross-sectional lead parts of the second member while one end of the first member is inserted between the rectangular cross-sectional lead parts of the second member.

Advantageous Effects

According to the present disclosure, a pogo pin, which serves as an upper probe and a lower probe, is directly connected to electronic components in semiconductor wafers, LCD modules, semiconductor packages, sockets, or the like, thereby minimizing electrical loss and distortion of electric signals transmitted between the electronic components. As a result, the electronic components employing the pogo pin may exhibit improved stability and reliability.

In addition, since the pogo pin does not include the cylindrical body, the length and outer diameter of the pogo pin may be minimized. Accordingly, the pogo pin may be used for a complex electronic component. Further, the pogo pin may be manufactured without a complicated process of forming the cylindrical body, resulting in mass production of the pogo pin with reduced costs.

BEST MODE

Figure 1:
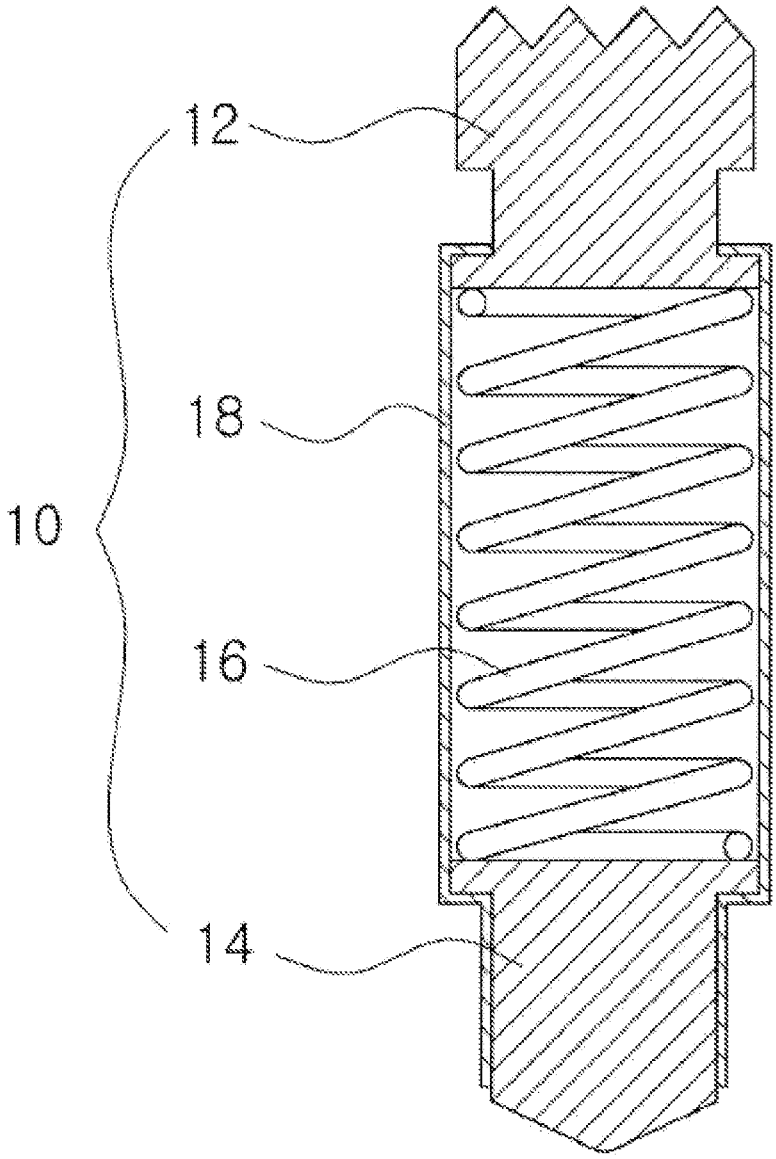
FIG. 1 is a cross-sectional view of a related pogo pin.
Figure 2:
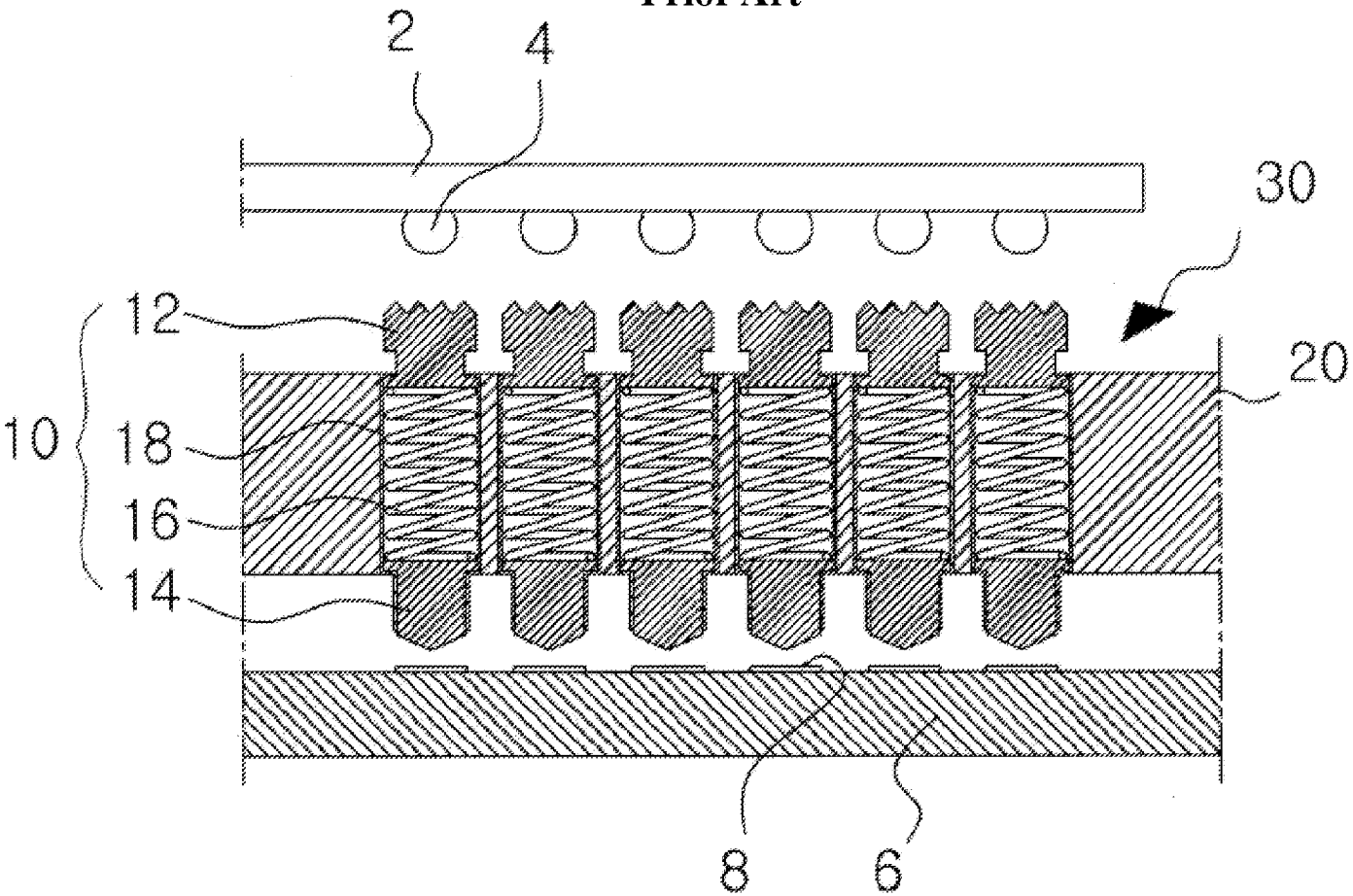
FIG. 2 is a cross-sectional view of one example of a socket for inspection of semiconductor packages, in which a plurality of pogo pins is received in a single dielectric body.

The following detailed description is provided to assist one skilled in the art in gaining a comprehensive understanding of the methods, apparatuses and/or systems described herein. The following description with reference to the drawings provides illustrative examples of devices and methods according to embodiments of the invention. Such a description is for illustrative purposes only and not for purposes of limiting the same. Descriptions of functions and structures unrelated to the embodiments of the invention are omitted from the drawings to enhance clarity and conciseness. Further, like components are denoted by like reference numerals throughout the drawings and the detailed description.

1. First Embodiment

Figure 3:
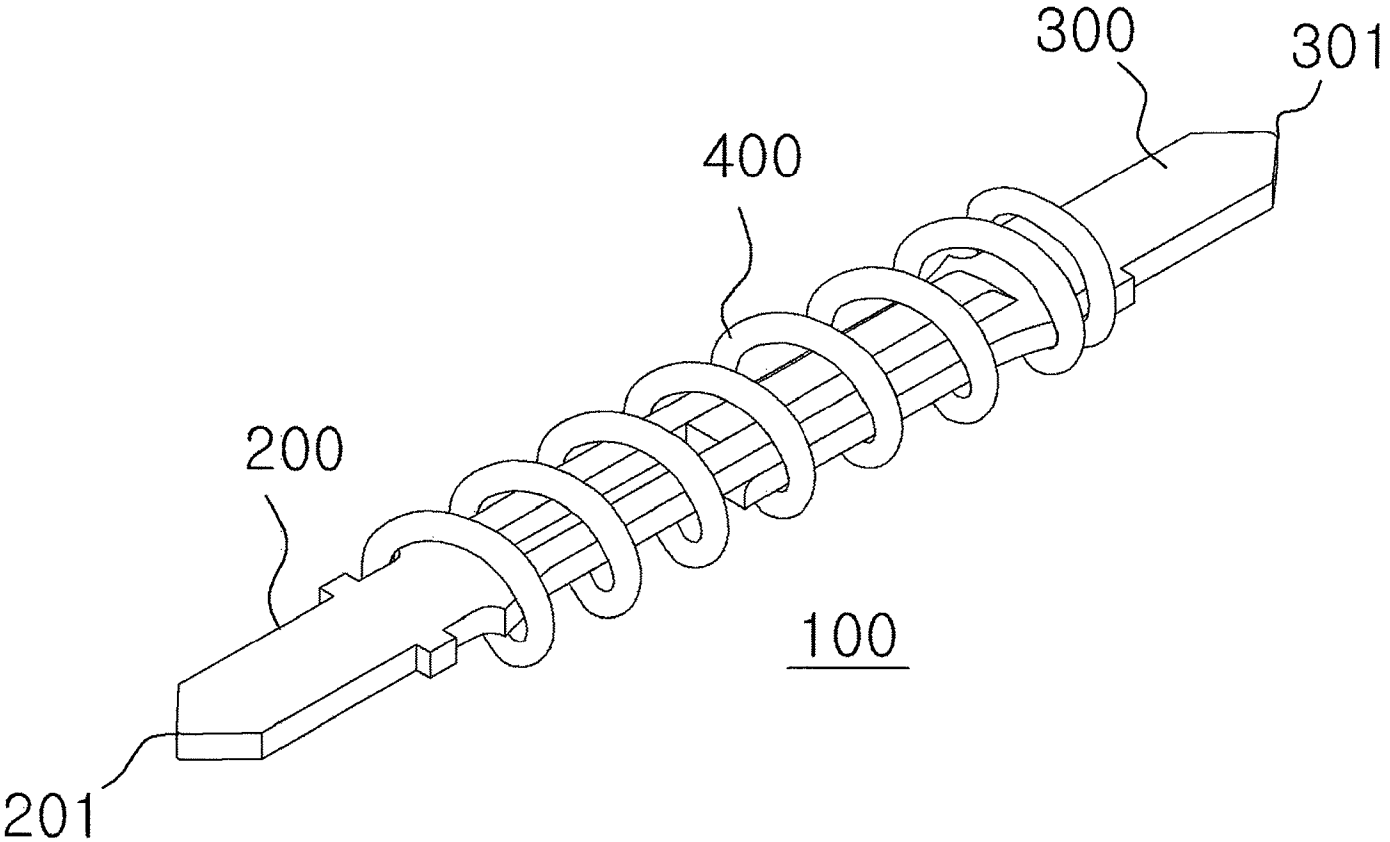
FIG. 3 is a perspective view of a pogo pin according to a first embodiment of the present invention.

FIG. 3 is a perspective view of a pogo pin according to a first embodiment of the present invention.

The pogo pin 100 includes a first member 200, a second member 300, and a spring 400. The first member 200 and the second member 300 correspond to an upper probe and a lower probe, respectively, or vice versa.

Each of contact portions 201, 301 of the first and second members 200, 300 is brought into contact with, for example, a terminal of a semiconductor package, a terminal of an LCD panel, a terminal of a circuit board, a terminal of a battery, a pad of a semiconductor wafer, or a pad of a test substrate.

The spring 400 receives part of each of the first and second members 200, 300 therein. The spring 400 is configured to apply elastic force to the first and second members 200, 300.

The first and second members 200, 300 may be brought into slidable contact with each other. Hence, electric signals are directly transmitted from the first member 200 to the second member 300, or vice versa. For the pogo pin 10 shown in FIG. 1, electric signals are transmitted via the cylindrical body 18 between the upper probe 12 and the lower probe 14. In the first embodiment, however, the pogo pin 100 allows electric signals to be directly transmitted between the first member 200 and the second member 300.

Figure 4:
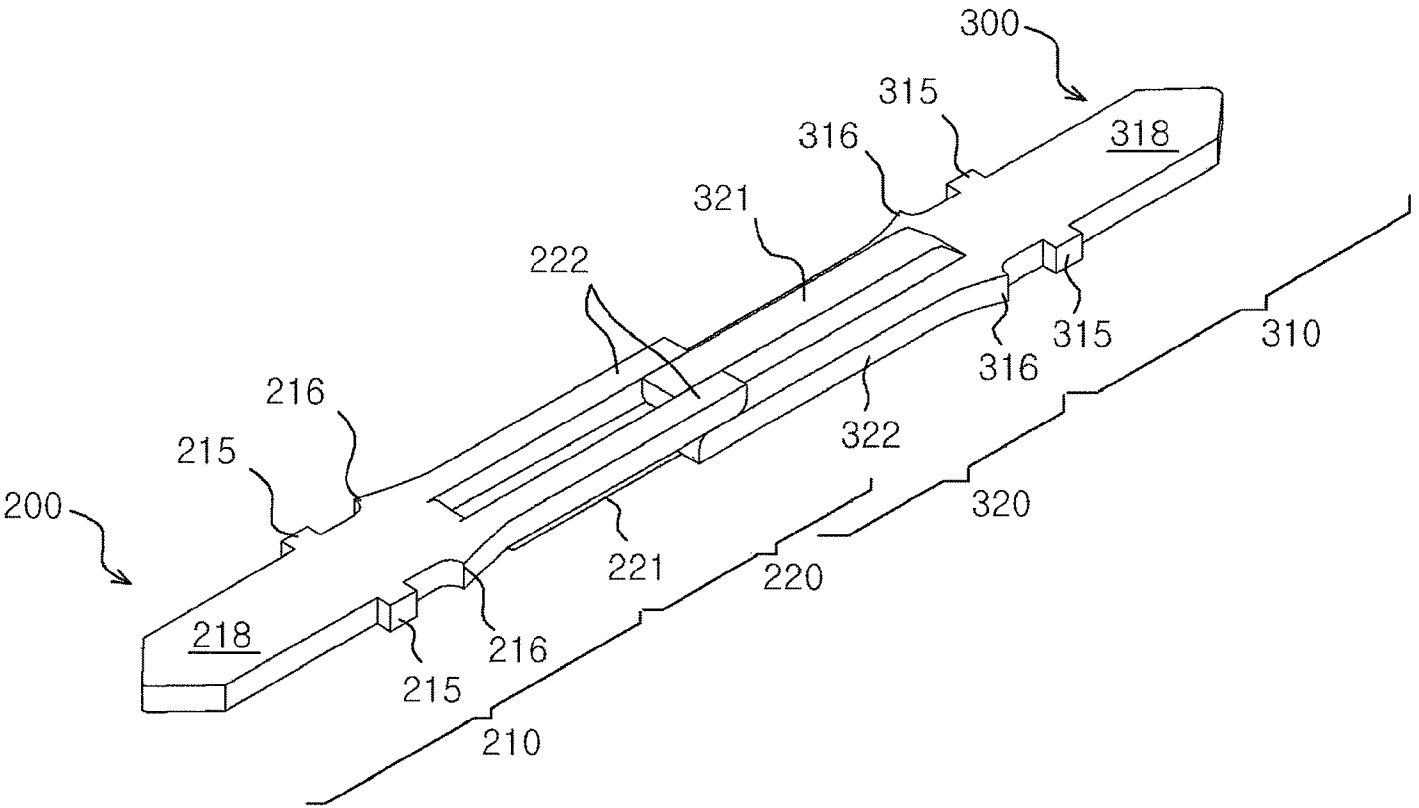
FIG. 4 is a view of a first member and a second member of the pogo pin according to the first embodiment of the present invention.

FIG. 4 is a view of the first member and the second member of the pogo pin according to the first embodiment of the present invention.

Figure 5:
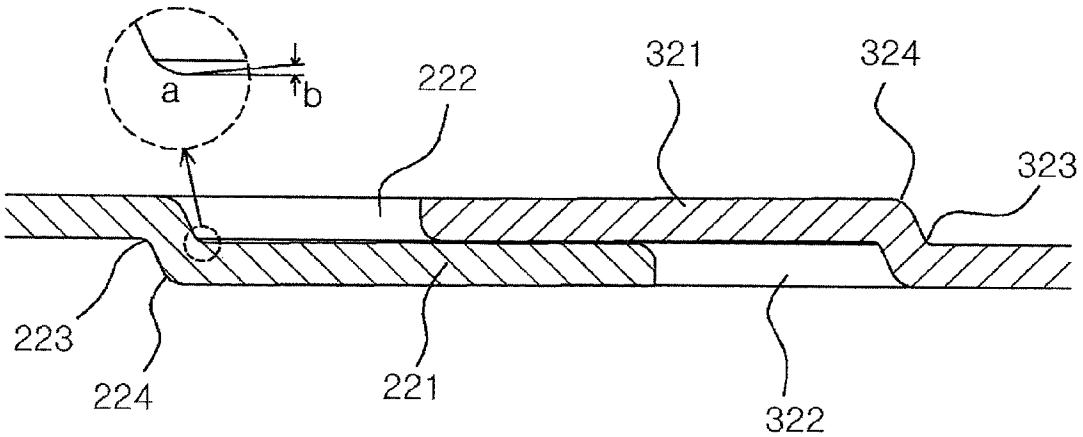
FIG. 5 is a side-sectional view taken along the center of the first and second members of the pogo pin according to the first embodiment of the present invention.
Figure 6:
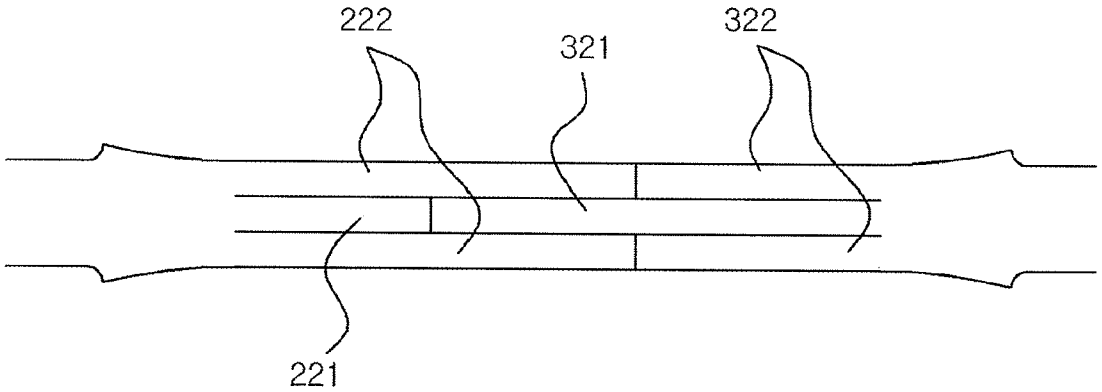
FIG. 6 is a top view of the first and second members of the pogo pin according to the first embodiment of the present invention.

FIGS. 5 and 6 illustrate connection bridges of the first and second members 200, 300 of the pogo pin. Specifically, FIG. 5 is a side-sectional view taken along the center of the first and second members 200, 300 and FIG. 6 is a top view of the first and second members 200, 300.

The first member 200 and the second member 300 are dually provided. In this case, the first member 200 and the second member 300 may be identical to each other or different from each other. Unless otherwise stated, the description of the first member 200 may also be applied to the second member 300. Therefore, the description of the second member 300 may be omitted.

The first member 200 is comprised of a first body 210 and a first connection portion 220, while the second member 300 is comprised of a second body 310 and a second connection portion 320.

The first body 210 serves as a frame of the first member 200. The first connection portion 220 is integrally formed with the first body 210 and extends from the first body 210.

The first and second members 200, 300 are electrically connected to each other via the first and second connection portions 220, 320. The first and second connection portions 220, 320 are brought into surface-to-surface contact with each other and are configured to slide with respect to each other.

The first connection portion 220 includes a first middle connection bridge 221 longitudinally extending from the first body 210, and a pair of first side connection bridges 222 placed on both sides of the first middle connection bridge 221 and longitudinally extending from the first body 210.

The second connection portion 320 includes a second middle connection bridge 321 longitudinally extending from the second body 310, and a pair of second side connection bridges 322 placed on both sides of the second middle connection bridge 321 and longitudinally extending from the second body 310.

The first middle connection bridge 221 longitudinally extends in a step-shaped manner from the first body 210. Specifically, the first middle connection bridge 221 is bent at first and second bending points 223, 224.

The second middle connection bridge 321 longitudinally extends in a step-shaped manner from the second body 310. Specifically, the second middle connection bridge 321 is bent at third and fourth bending points 323, 324.

Since the first and second middle connection bridges 221, 321 are bent at the first, second, third and fourth bending points 223, 224, 323, 324, the first and second middle connection bridges 221, 321 are formed to extend in a step-shaped manner with respect to the first and second bodies 210, 220, respectively.

The first and second connection portions 220, 320 are brought into surface-to-surface contact with each other and are configured to slide with respect to each other. The pair of first side connection bridges 222 of the first connection portion 220 is laid over the pair of second side connection bridges 322 of the second connection portion 320. The pair of first side connection bridges 220 and the pair of second side connection bridges are brought into surface-to-surface contact with each other and are configured to slide with respect to each other. In FIG. 4, the pair of first side connection bridges 222 is laid over the pair of second side connection bridges 322 and slides with respect to the pair of second side connection bridges 322.

On the other hand, the first middle connection bridge 221 is placed under the second middle connection bridge 321 and is configured to slide with respect to the second middle connection bridge 321. Due to the step-shaped extension of the first and second middle connection bridges 221, 321, the first and second middle connection bridges 221, 321 overlap each other in an opposite sequence to that of the first and second side connection bridges 222, 322.

When seen from a different point of view, the first and second middle connection bridges 221, 321 slide with respect to each other, the first middle connection bridge 221 being placed between the pair of second side connection bridges 322 and the second middle connection bridge 321 being placed between the first side connection bridges 222.

The pair of first side connection bridges 222 and the pair of second side connection bridges 322 face each other. That is, referring to FIG. 5, the sliding surfaces of the pair of first side connection bridges 222 face downwards, while the sliding surfaces of the pair of second side connection bridges 322 face upwards.

Further, the first middle connection bridge 221 has a sliding surface facing in an opposite direction to that of the sliding surfaces of the pair of first side connection bridges 222. That is, the sliding surfaces of the pair of first side connection bridges 222 face downwards, while the sliding surface of the first middle connection bridge 221 faces upwards. Further, the second middle connection bridge 321 has a sliding surface facing in an opposite direction to that of the sling surfaces of the pair of second side connection bridges 322. That is, the sliding surfaces of the pair of second side connection bridges 322 face upwards, while the sliding surface of the second middle connection bridge 321 faces downwards.

The pair of first side connection bridges 222 is brought into slidable contact with the pair of second side connection bridges 322, and the first middle connection bridge 221 is brought into slidable contact with the second middle connection bridge 321.

As shown in FIG. 5, the first middle connection bridge 221 is bent from the first body to form a step greater than the thickness of each of the first side connection bridges 222.

Accordingly, point "a" of the first middle connection bridge 221 is located below the lower surfaces of the first side connection bridges 222. The first middle connection bridge 221 inclines gradually upwards from this point "a". Accordingly, the first middle connection bridge 221 is inclined at an angle "b" with respect to a horizontal plane. The angle "b" may be greater after the first and second middle connection bridges 221, 321 are coupled with each other than before they are coupled with each other. Thus, when the first middle connection bridge 221 is coupled with the second middle connection bridge 321, the first and second middle connection bridges 221, 321 compress each other, causing the first and second side connection bridges 222, 322 to compress each other.

Meanwhile, the first middle connection bridge 221 and/or the second middle connection bridge 321 may be formed to have the angle "b". Accordingly, the first middle connection bridge 221 may compress the second middle connection bridge 321, the second middle connection bridge 321 may compress the first middle connection bridge 221, or the first middle connection bridge 221 and the second middle connection bridge 321 may compress each other at the same time.

The first body 210 includes a first body part 218, a first stopper 215, and a first latch 216.

The first body part 218 serves as a frame of the first member 200. The first stopper 215 protrudes from either side of the first body part 218 to prevent the spring 400 from being separated from the first member 200. The first latch 216 protrudes from either side of the first body part 218 to allow one end of the spring 400 to be placed between the first stopper 215 and the first latch 216. The spring 400 is coupled with the first body 210 by compressing the one end of the spring 400, passing by the first latch 216, and placing the spring 400 between the first stopper 215 and the first latch 216. When the one end of the spring 400 is released, the one end of the spring 400 is only placed between the first stopper 215 and the first latch 216.

Figure 14:
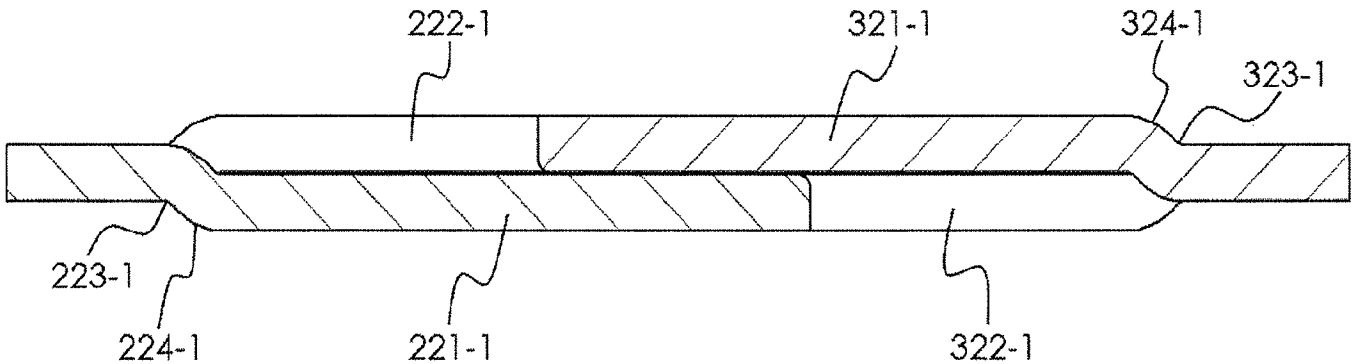
FIG. 14 illustrates a pogo pin which includes a different shape of side connection bridge.

FIG. 14 illustrates a pogo pin which includes a different shape of side connection bridge.

FIGS. 3 to 6 illustrate a pogo pin where the first side connection bridges 222 and the second side connection bridges 322 extend straightly from the first body part 218 and the second body part 318, respectively. On the other hand, FIG. 14 illustrates a pogo pin where first side connection bridges 222-1 extend in a step-shaped manner from the first body part 218 and second side connection bridges 322-1 also extend in a step-shaped manner from the second body 328.

The structure of the slidable pogo pin has been described above. However, it should be understood that the foregoing structure of the slidable pogo pin may also be applied to an electrical connection pin which establishes electrical connection between certain points. In this case, the electrical connection pin may not include the spring, the latch and the stopper, which are included in the pogo pin.

Figure 7:
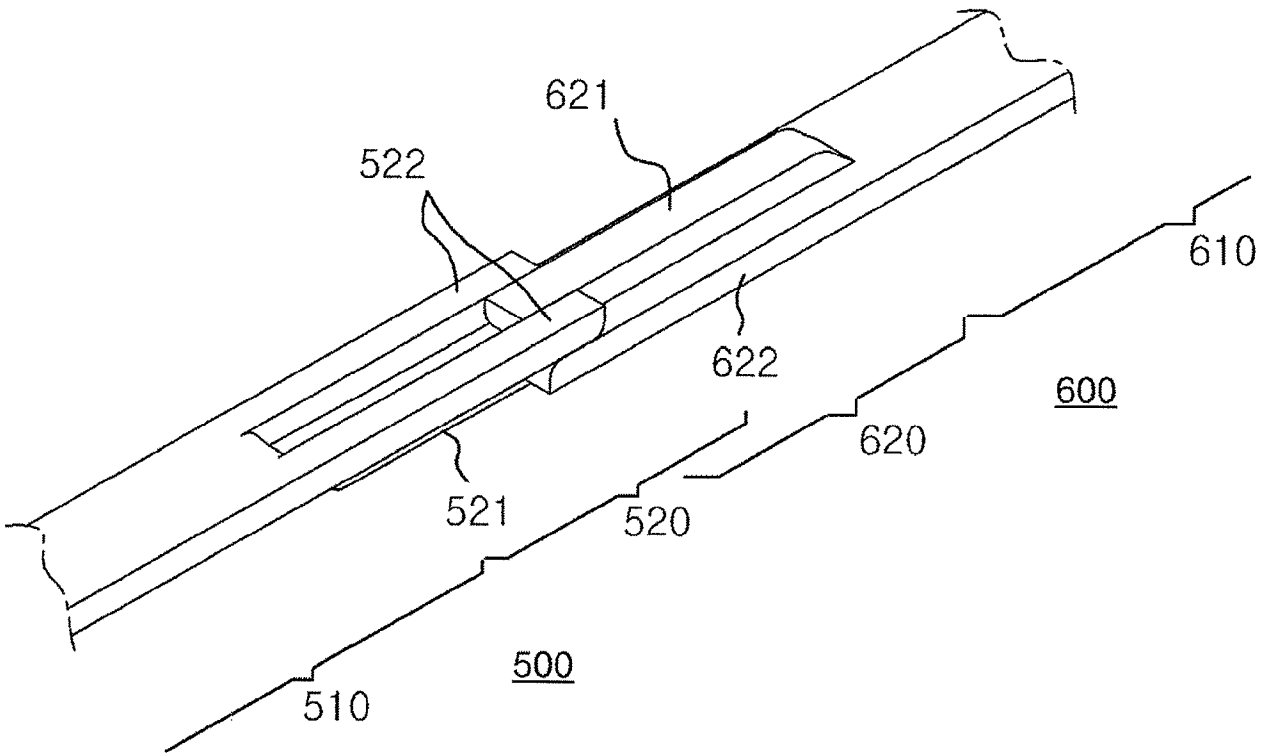
FIG. 7 is a view of an electrical connection pin according to one embodiment of the present invention.

FIG. 7 is a view illustrating an electrical connection pin according to an embodiment of the present invention.

The electrical connection pin generally has the same structure as that of the pogo pin 100 shown in FIG. 3 to FIG. 6, with the exception of not including the spring, the latch and the stopper.

A first member 500 includes a first body 510 and a first connection portion 520. A second member 600 includes a second body 610 and a second connection portion 620.

The first connection portion 520 includes a first middle connection bridge 521 and a pair of first side connection bridges 522. The second connection portion 620 includes a second middle connection bridge 621 and a pair of second side connection bridges 622. The first middle connection bridge 521, the pair of first side connection bridge 522, the second middle connection bridge 621 and the pair of second side connection bridges 622 have the same structures and functions as the corresponding connection bridges of the slidable pogo pin described above, and a detailed description thereof will thus be omitted herein.

As described above, the slidable pogo pin and the electrical connection pin is each configured to include one middle connection bridge and two side connection bridges. However, it should be understood that the present embodiment is not limited thereto. For example, the slidable pogo pin and the electrical connection pin may be each configured to include two middle connection bridges and three side connection bridges. Further, the slidable pogo pin and the electrical connection pin may be each configured to include more connection bridges which are integrally formed with the first and second bodies.

2. Second Embodiment

Figure 8:
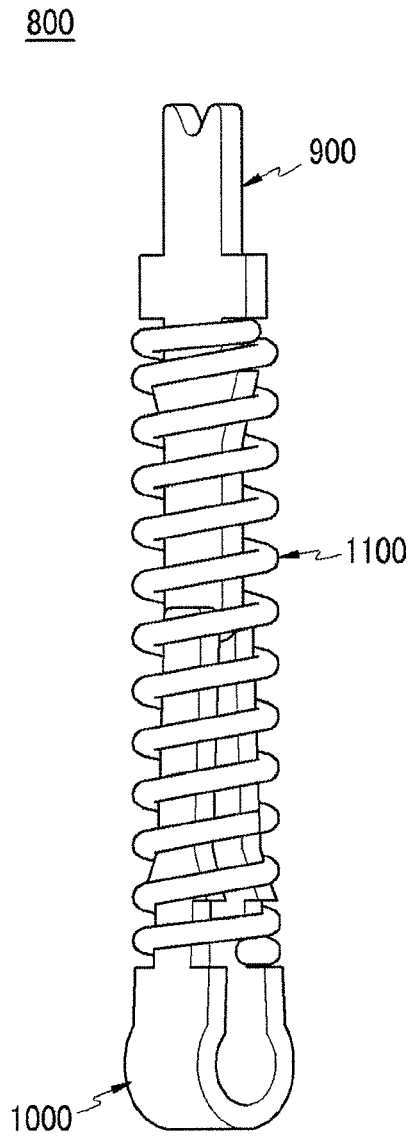
FIG. 8 is a perspective view of a pogo pin according to a second embodiment of the present invention.

FIG. 8 is a perspective view of a pogo pin 800 according to a second embodiment of the present invention.

The pogo pin 800 includes a first member 900, a second member 1000, and a spring 1100. The first member 900 and the second member 1000 correspond to an upper probe and a lower probe, respectively, or vice versa. However, in the following description, it is assumed that the first member 900 corresponds to the upper probe and the second member 1000 corresponds to the lower probe.

The spring 1100 receives part of each of the first and second members 900, 1000 therein. The spring 1100 is configured to apply elastic force to the first and second members 900, 1000.

Figure 9:
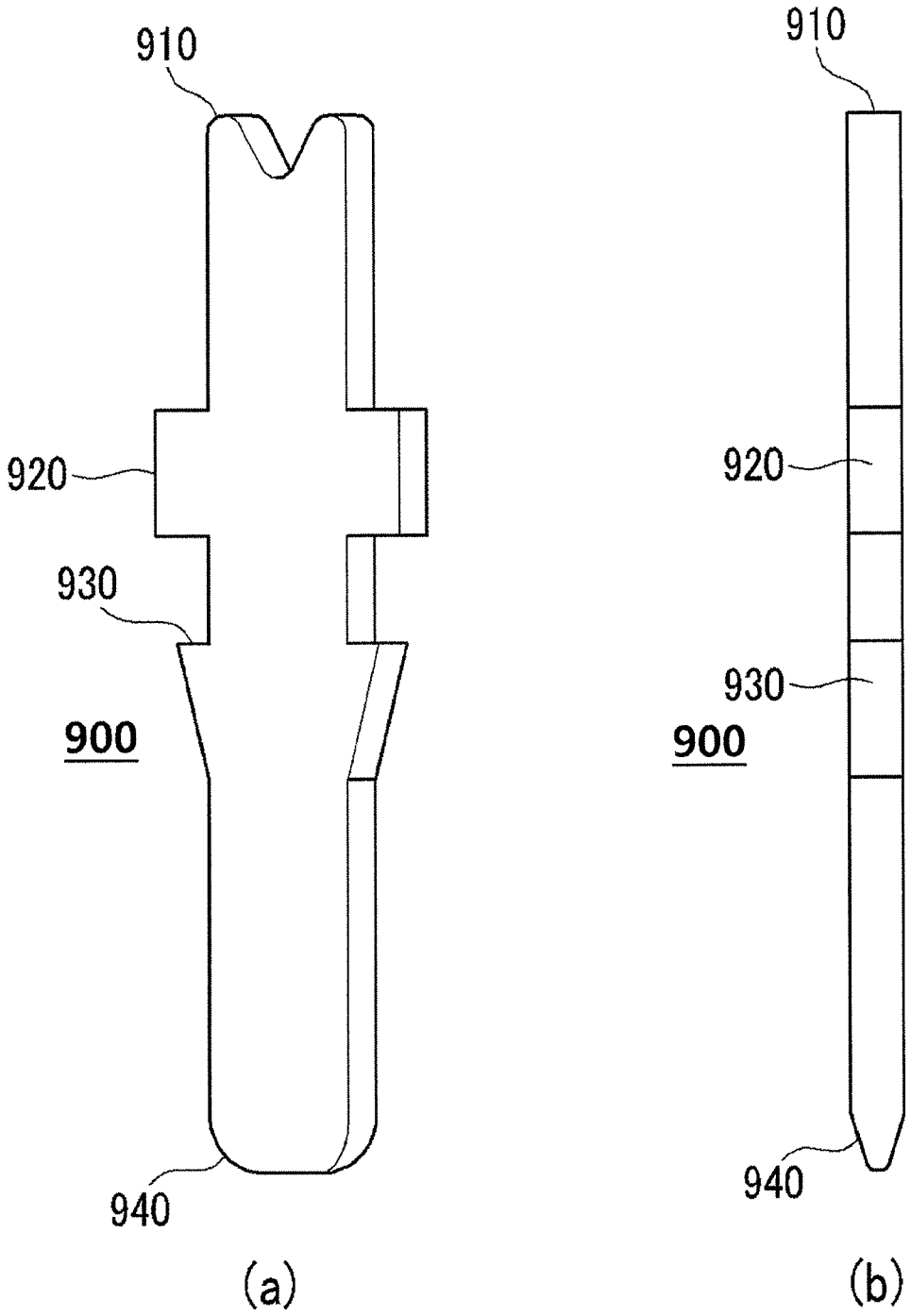
FIG. 9 is a solid view and a side view of a first member of the pogo pin according to the second embodiment of the present invention.

FIG. 9 is a solid view and a side view of a first member of the pogo pin according to the second embodiment of the present invention.

In the second embodiment, the first member 900 functions as the upper probe of the pogo pin and is embodied as a straight-line shaped plate.

The first member 900 includes a first probe 910, a first stopper 920, a first latch 930, and an insertable connection portion 940. The first member 900 is provided at one end thereof with the first probe 910 and at the other end thereof with the insertable connection portion 940.

Figure 10:
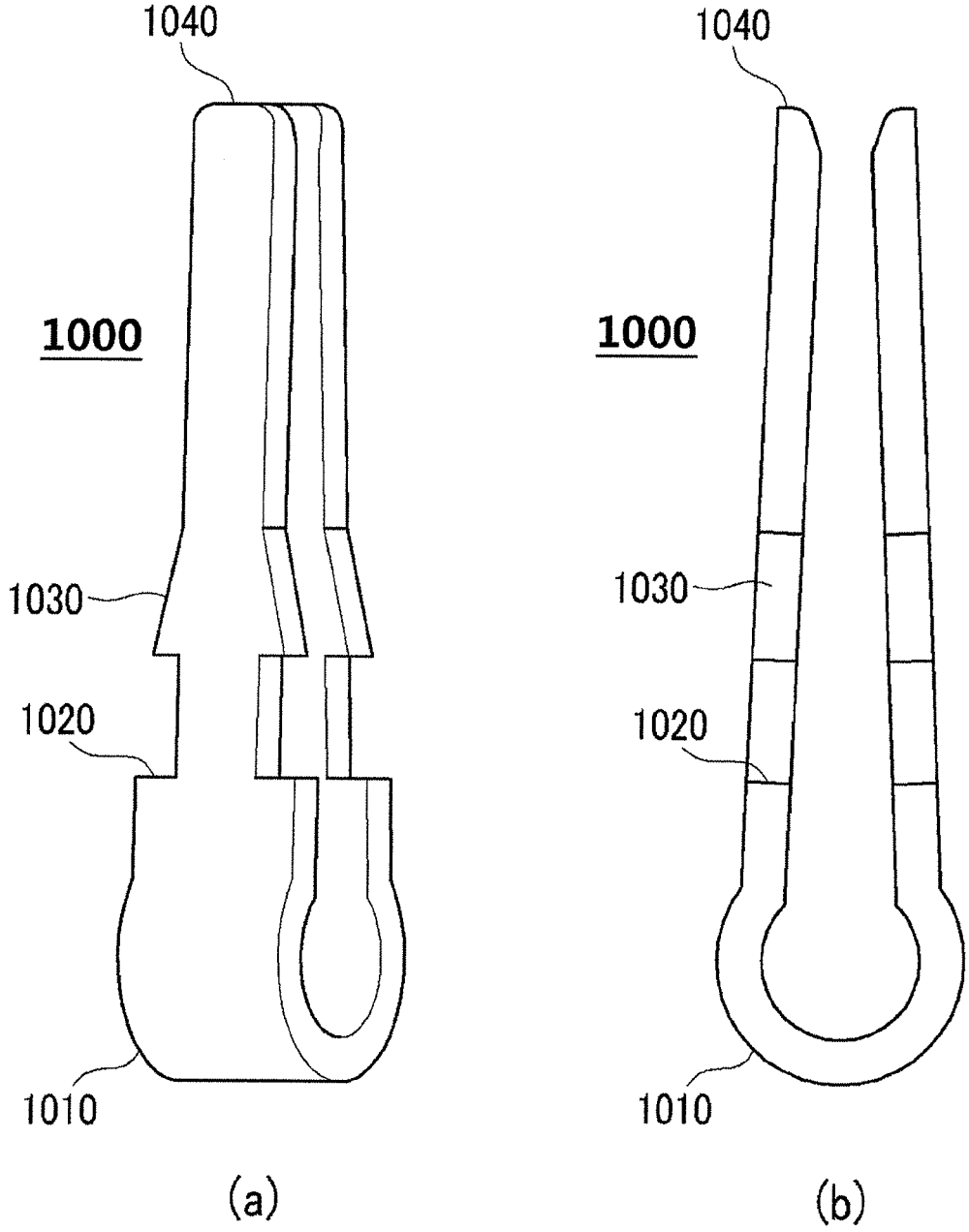
FIG. 10 is a solid view and a side view of a second member of the pogo pin according to the second embodiment of the present invention.

FIG. 10 is a solid view and a side view of the second member of the pogo pin according to the second embodiment of the present invention.

In the second embodiment, the second member 1000 is of U-shape and serves as a lower probe of the pogo pin. It should be understood that the second member 1000 is not limited to the "U" shape and may be of any shape, such as V-shape, Y-shape, and /\-shape, which is branched into two at one side thereof.

The second member 1000 includes a second probe 1010, a second stopper 1020, a second latch 1030, and two rectangular cross-sectional lead parts 1040. In this embodiment, the second member may include two second stoppers 1020 and two second latches 1030. The second member 1000 has the second probe 1010 at one end thereof and the two rectangular cross-sectional lead parts 1040 at the other end thereof.

When the second member 1000 is coupled to the first member 900, the insertable connection portion 940 of the first member 900 is inserted between the two rectangular cross-sectional lead parts 1040.

The first probe 910 of the first member 900 and the second probe 1010 of the second member 1000 will each be brought into contact with a terminal of a semiconductor package, a terminal of an LCD panel, a terminal of a circuit board, a terminal of a battery, a pad of a semiconductor wafer, a pad of a test substrate, or the like.

The first stopper 920 is configured to prevent the spring 1100 from being separated from the first member 900. The first latch 930 is configured to prevent an end of the spring 1100 from being escaped from between the first stopper 920 and the first latch 930. Accordingly, the first stopper 920 and the first latch 930 are configured to protrude from the first member 900. Further, the first latch 930 is formed to be inclined so that the spring 1100 may be easily assembled with the first member 900.

The second stopper 1020 is configured to prevent the spring 1100 from being separated from the second member 1000. The second latch 1030 is configured to prevent the other end of the spring 1100 from being escaped from between the second stopper 1020 and the second latch 1030. Accordingly, the second stopper 1020 and the second latch 1030 are configured to protrude from the second member 1000. Further, the second latch 1030 is formed to be inclined so that the spring 1100 may be easily assembled with the second member 1000.

If the outer dimension of the first latch 930 or the second latch 1030 is greater than an inner diameter of the spring 1100 so that the spring 1100 may not pass through the first latch 930 or the second latch 1030, the end of the spring 1100 is compressed to have an elliptical cross-section, fitted on the first latch 930 or the second latch 1030, and released so that the spring 1100 may be secured to the first latch 930 or the second latch 1030. Accordingly, one end of the spring 1100 is placed between the first stopper 920 and the first latch 930, and the other end of the spring is placed between the second stopper 1020 and the second latch 1030.

Figure 11:
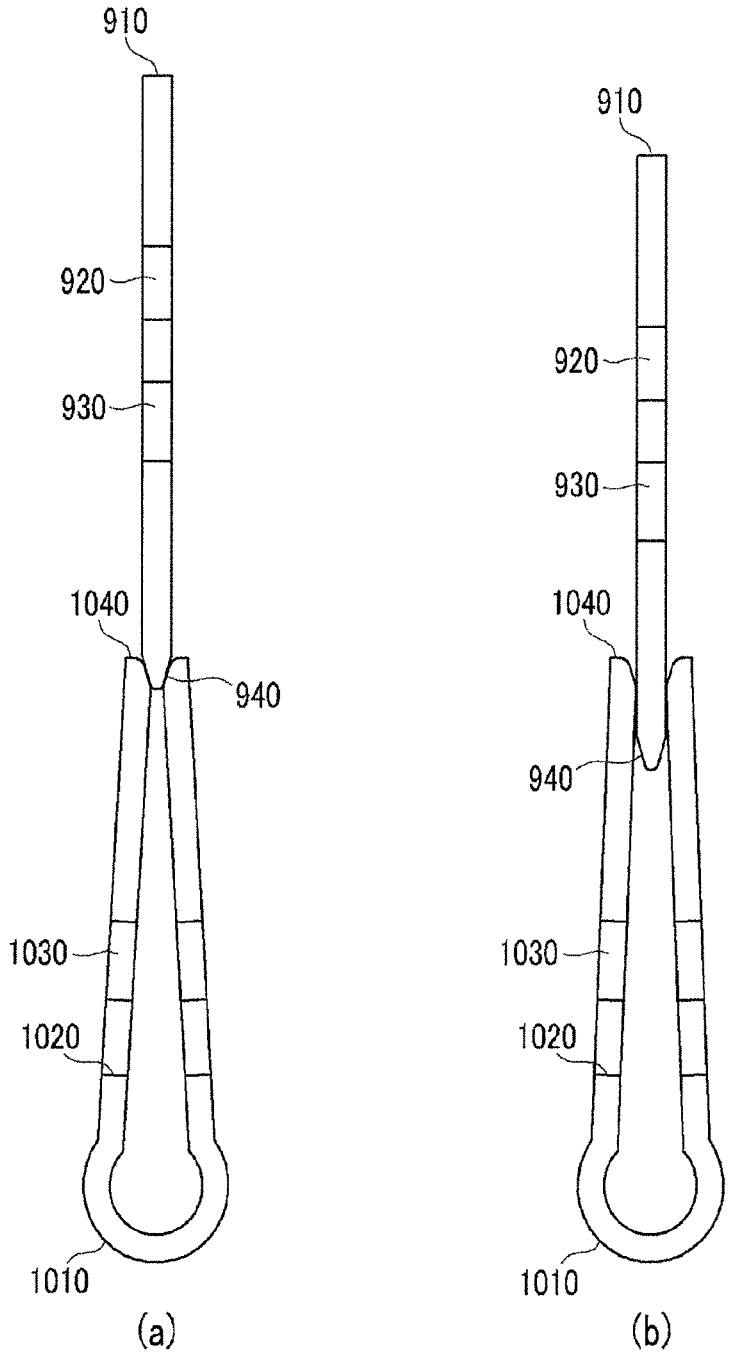
FIG. 11 is a side view illustrating a method of fastening the first and second members of the pogo pin according to the second embodiment of the present invention.

FIG. 11 is a side view illustrating a method of fastening the first and second members of the pogo pin according to the second embodiment.

In the pogo pin, the first and second members 900, 1000 are placed at opposite ends of the spring 1100 and elastically supported by the spring 1100. The insertable connection portion 940 of the first member 900 is configured to be inserted between the rectangular cross-sectional lead parts 1040 of the second member 1000. Each of the first and second members 900, 1000 is configured to freely move upwards or downwards depending on load applied thereto.

In the second member 1000, the two rectangular cross-sectional lead parts 1040 are configured to face each other and elastically compress both sides of the insertable connection portion 940 of the first member 900. Accordingly, electrical connection may be constantly established between the first member 900 and the second member 1000.

Further, since the insertable connection portion 940 of the first member 900 is brought into slidable contact with the rectangular cross-sectional lead parts 1040 of the second member 1000, electric signals are directly transmitted from the insertable connection portion 940 of the first member 900 to the rectangular cross-sectional lead parts 1040 of the second member 1000, or vice versa.

Figure 15:
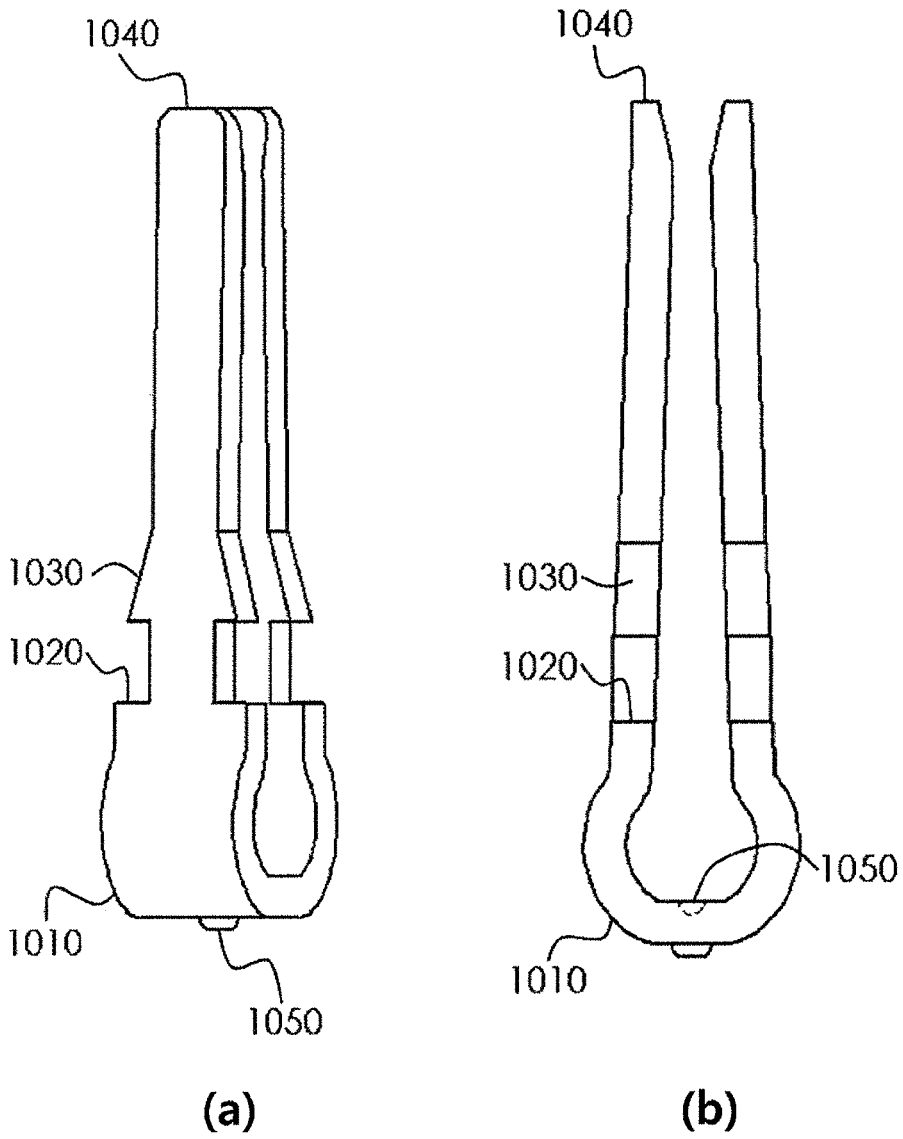
FIG. 15 illustrates a modified example of the pogo pin according to the second embodiment of the present invention.

FIG. 15 illustrates a modified example of the pogo pin according to the second embodiment of the present invention.

Referring to FIG. 15, the pogo pin further includes a contact portion 1050, which protrudes from a lower end of the second probe 1010, unlike the pogo pins shown in FIG. 8 to FIG. 11. The contact portion 1050 is a component for electrical contact with an electronic device or a contact pad. The contact portion 1050 may be easily formed by pressing or the like.

3. Third Embodiment

According to a third embodiment of the invention, a pogo pin includes first and second members corresponding to upper or lower probes, respectively, and a spring configured to apply elastic force to the first and second members. In this embodiment, the pogo pin has the same fastening structure as that of the pogo pin shown in FIG. 8.

Figure 12:
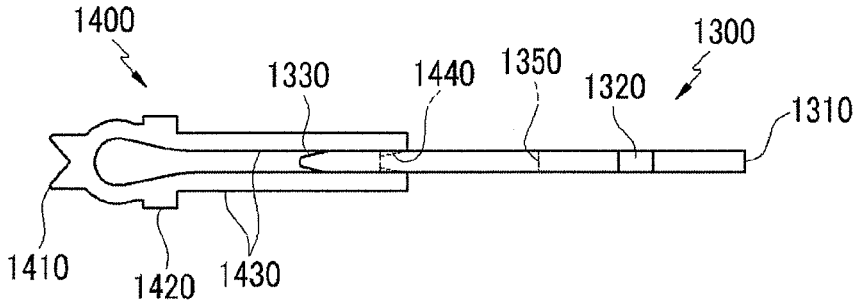
FIG. 12 is a side view illustrating a method of fastening first and second members of a pogo pin according to a third embodiment of the present invention.
Figure 12:
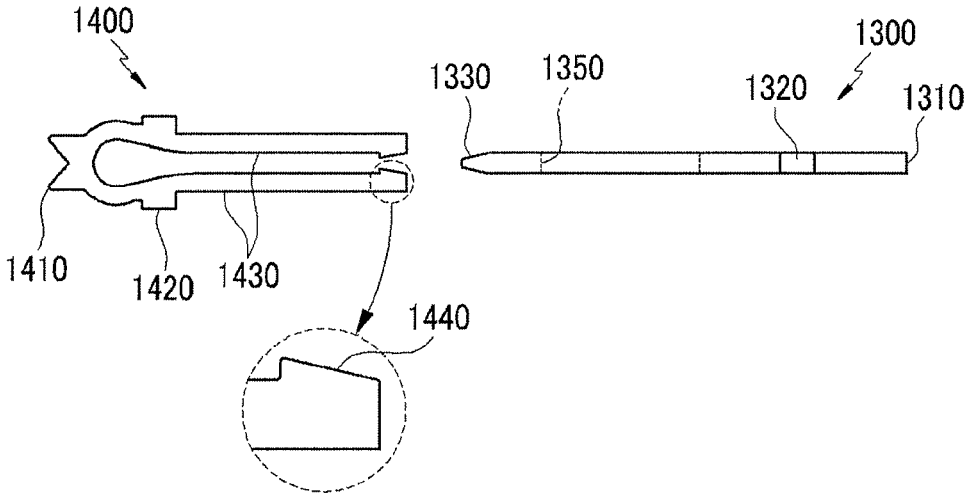

FIG. 12 is a side view illustrating a method of fastening the first and second members of the pogo pin according to the third embodiment of the invention.

In the pogo pin 1200, the first member 1300 includes a first probe 1310, a first stopper 1320, and an insertable connection portion 1330. The second member 1400 includes a second probe 1410, a second stopper 1420 and two rectangular cross-sectional lead parts 1430.

The first and second probes 1310, 1410 will be brought into contact with a terminal of a semiconductor package, a terminal of an LCD panel, a terminal of a circuit board, a terminal of a battery, a pad of a semiconductor wafer, a pad of a test substrate, or the like. The first and second stoppers 1320, 1420 are configured to prevent the spring from being separated from the first and second members.

In the second member 1400, each of the rectangular cross-sectional lead parts 1430 has a latch protrusion 1140 protruding inwards at an end thereof. The latch protrusion 1440 prevents the first and second members 1300, 1400 from being separated from each other when the first and second members 1300, 1400 move upwards and downwards. For this purpose, the latch protrusion 1440 is inserted into a latch groove 1340 formed on the first member 1300.

Figure 16:
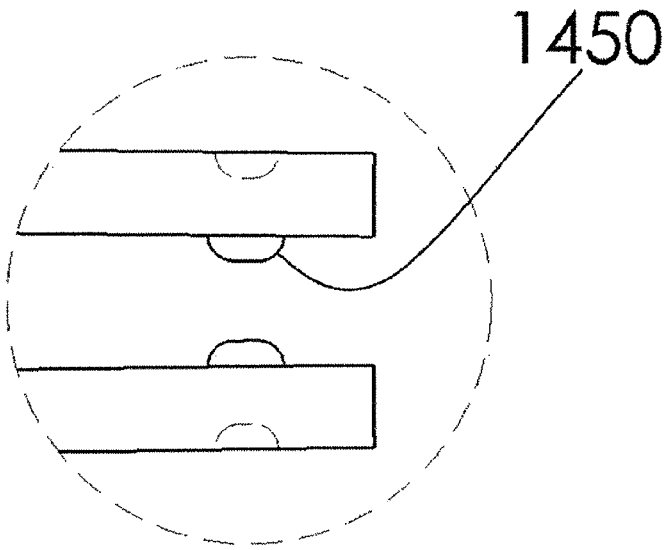
FIG. 16 illustrates a different shape of latch protrusion in the pogo pin according to the third embodiment of the present invention.

FIG. 16 illustrates a different shape of latch protrusion in the pogo pin according to the third embodiment. The latch protrusion 1440 of FIG. 12 is of step shape, while the latch protrusion of FIG. 16 is of round shape by pressing.

Figure 13:
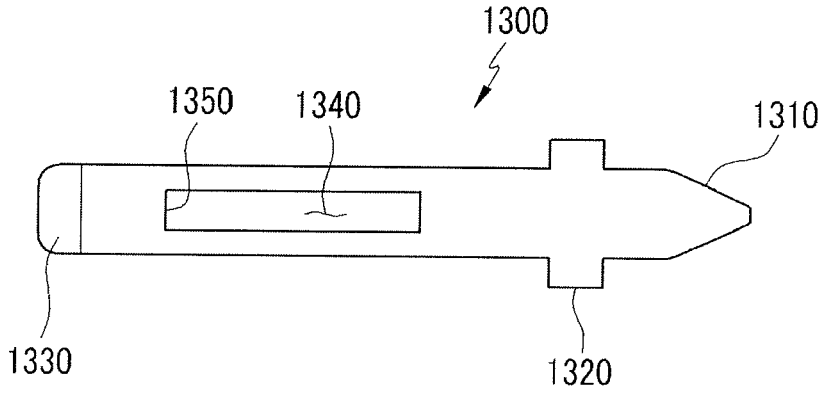
FIG. 13 is a plan view of the first member of the pogo pin according to the third embodiment of the present invention, which has a latch groove formed thereon.

FIG. 13 is a plan view of the first member of the pogo pin according to the third embodiment, the first member having a latch groove.

In the third embodiment, the first member 1300 has a latch groove 1340 and a latch jaw 1350. The latch groove 1340 is configured to allow the latch protrusion 1440 of the second member 1400 to move upwards or downwards. The latch jaw 1350 is configured to prevent the latch protrusion 1440 from being separated from the latch groove 1340.

Since the first member 1300 is fastened to the second member 1400 in the foregoing manner, the first and second members 1300, 1400 may be freely moved up and down while the first and second members 1300, 1400 are brought into contact with each other.

Further, since the insertable connection portion 1330 of the first member 1300 is brought into slidable contact with the rectangular cross-sectional lead parts 1430 of the second member 1400, electric signals are directly transmitted from the insertable connection portion 1330 of the first member 1300 to the rectangular cross-sectional lead parts 1430 of the second member 1400, or vice versa.

4. Method of Manufacturing Slidable Pogo Pin

The above-mentioned slidable pogo pin may be manufactured by machining a single metal sheet. Specifically, each of the first members 200, 900, 1300 and the second members 300, 1000, 1400 may be manufactured by blanking and bending a metal sheet by a stamping process, and heat treatment and plating of the metal sheet. The heat treatment and plating may be performed before the blanking and bending.

Next, a method of manufacturing each of the pogo pins according to the embodiments will be described.

In order to manufacture the pogo pin 100 according to the first embodiment, the first and second members 200, 300 are first provided.

To provide the first and second members 200, 300, a metal sheet is subjected to blanking, thereby obtaining the bodies 210, 310 and the connection portions 220, 320 without forming the first and second middle connection bridges 221, 321. Then, the metal sheet is bent at the respective bending points 223, 224, 323, 324, thereby obtaining a structure with the shapes of the first and second members. In this case, progressive stamping may be used. Next, the structure is subjected to heat treatment and plating, resulting in the first and second members 200, 300.

After the first and second members 200, 300 are obtained, both ends of the spring 400 are compressed to pass through the latches 216, 316 and are placed between the stopper 215 or 315 and the latch 216 or 316.

Through this process, the pogo pin 100 according to the first embodiment of the present invention may be obtained.

In order to manufacture the pogo pin 800 according to the second embodiment, a metal sheet is subjected to blanking, bending, plating and heat treatment, resulting in the first and second members 900, 1000. After the first and second members 900, 1000 are obtained, one end of the spring 1100 is coupled to the second member 1000 and fixed to the second latch 1030. Then, the insertable connection portion 940 of the first member 900 is inserted between the rectangular cross-sectional lead parts 1040 of the second member 1000. When the first member 900 is coupled to the second member 1000, the other end of the spring 1100 is coupled to the first member 900 and fixed to the first latch 930.

Through this process, the pogo pin 800 according to the second embodiment of the present invention may be obtained.

A method of manufacturing the pogo pin 1200 according to the third embodiment is the same as the method of manufacturing the pogo pin 800 according to the second embodiment with the exception of omitting the bending operation; therefore, a detailed description thereof will be omitted herein.

For the slidable pogo pin or the electrical connection pin according to the first to third embodiments, each of the first and second members may be advantageously obtained from a single sheet material. In other words, since the body and the connection portion are integrally formed for each of the structures, it is possible to manufacture each of the first and second members from a single sheet material.

According to the embodiments of the invention, it is preferable that the sheet material for each of the first and second members is flexible in the bending process, has increased elasticity and strength through heat treatment, and has a low electrical resistance. In this case, beryllium-copper alloy may be used. In particular, beryllium-copper 25 alloy, such as ASTMC17200, may be used. It should be understood that any material satisfying the mechanical and electrical requirements of the first and second members may also be used.

On the other hand, a plating material with a low electrical resistance, such as gold, may be used in the plating operation. Further, heat treatment, such as annealing, normalizing, quenching, and tempering, may be employed.

The spring may be made of a material with high elasticity, high tensile strength, and high fatigue strength. However, the spring does not have to be made of a material with low electrical resistance. The spring may be made of, without limitation, spring steel or stainless steel. That is, any material satisfying the mechanical requirements of the spring may also be used.

In the embodiments of the invention, the first and second members are configured to be elastically supported by the spring and move upwards or downwards movable depending on load applied thereto.

Further, since the first and second connection portions are brought into slidable surface-to-surface contact with each other, electric signals may be stably transmitted. Accordingly, it is possible to minimize loss and distortion of the electric signals; therefore, the present embodiments are suitable for high-integration and high-frequency circuits.

Further, according to the embodiments of the invention, the pogo pin may be manufactured without the cylindrical body of the conventional pogo pin. The conventional pogo pin generally includes a cylindrical body with a thickness of 0.05 mm or more. Further, for the conventional pogo pin, the cylindrical body and the spring have a gap of 0.015 mm therebetween. Accordingly, since the pogo pin according to the embodiments may be manufactured without the cylindrical body, it is possible to save a space of 0.13 mm, which is equal to the sum of two times the thickness of the cylindrical body and two times the gap.

For example, assuming that a conventional pogo pin includes a spring with an outer diameter of 0.37 mm and a cylindrical body with an outer diameter of 0.5 mm, external terminals are spaced apart from each other by a distance of 0.65 mm or more to be applied to the conventional pogo pin. That is, the conventional pogo pin may only be applied to a semiconductor package with external terminals which are spaced apart from each other by a pitch of 0.6 mm or more.

However, since the pogo pin according to the embodiments may be manufactured without the cylindrical body, the pitch may be 0.47 mm or more. Hence, the pogo pin may be applied to a variety of applications.

Further, for the conventional pogo pin, since it is difficult to form the cylindrical body, the cost of assembling elements within the cylindrical body is very high. However, since the pogo pin according to the embodiments of the invention may be manufactured without the cylindrical body, assembling other elements within the cylindrical body is not needed, thereby significantly reducing manufacturing cost.

Although the present invention has been described with reference to some embodiments in conjunction with the drawings, it should be understood that these embodiments are given by way of illustration only and do not limit the scope of the invention, and that various modifications, variations, and alterations can be made by those skilled in the art without departing from the spirit and scope of the invention.

The invention claimed is:

1. A pogo pin, comprising:

a first member including a first body and a first connection portion extending from the first body and integrally formed with the first body;

a second member including a second body and a second connection portion extending from the second body and integrally formed with the second body; and a spring applying elastic force to the first member and the second member, with at least a part of the first member and at least a part of the second member inserted into the spring, wherein the first member and the second member are electrically connected to each other via the first connection portion and the second connection portion, and the first connection portion and the second connection portion are configured to slide with respect to each other while the first connection portion is brought into surface-to-surface contact with the second connection portion, wherein the first connection portion comprises:

a first middle connection bridge longitudinally extending from the first body, and at least one first side connection bridge placed on a side of the first middle connection bridge and longitudinally extending from the first body; and the second connection portion comprises a second middle connection bridge longitudinally extending from the second body and at least one second side connection bridge placed on a side of the second middle connection bridge and longitudinally extending from the second body.

2. A pogo pin, comprising:

a first member formed of a straight line-shaped plate;

a second member having two rectangular cross-sectional lead parts formed at one end of the second member, and electrically connected to the first member via the two rectangular cross-sectional lead parts; and a spring applying elastic force to the first member and the second member, at least a part of the first member and at least a part of the second member inserted into the spring, wherein the first member is configured to slide between the rectangular cross-sectional lead parts of the second member while one end of the first member is inserted between the rectangular cross-sectional lead parts of the second member, wherein the first member comprises a first body and a first connection portion extending from the first body and integrally formed with the first body, and wherein the first body comprises:

a first body part serving as a frame of the first member, a first stopper protruding from the first body part and configured to prevent the spring from being separated from the first member, and a first latch protruding from the first body part and configured to hold one end of the spring between the first stopper and the first latch.

3. The pogo pin of claim 1, wherein the first middle connection bridge is configured to longitudinally extend in a step-shaped manner from the first body, and the second middle connection bridge is configured to longitudinally extend in a step-shaped manner from the second body.

4. The pogo pin of claim 1, wherein the at least one first side connection bridge comprises two first side connection bridges, the at least one second side connection bridge comprises two second side connection bridges, and when the first connection portion and the second connection portion slide with respect to each other while the first connection portion is brought into surface-to-surface contact with the second connection portion, the first middle connection bridge is placed between the two second side connection bridges, and the second middle connection bridge is placed between the two first side connection bridges.

5. The pogo pin of claim 1, wherein the at least one first side connection bridge slides with respect to the at least one second side connection bridge while the at least one first side connection bridge is brought into surface-to-surface contact with the at least one second side connection bridge.

6. The pogo pin of claim 1, wherein when the first connection portion and the second connection portion slide with respect to each other while the first connection portion is brought into surface-to-surface contact with the second connection portion, the first middle connection bridge is configured to press against the second middle connection bridge, the second middle connection bridge is configured to press against the first middle connection bridge, or the first middle connection bridge and the second middle connection bridge are configured to press against each other.

7. A pogo pin, comprising:

a first member including a first body, and a first middle connection bridge and two first side connection bridges each longitudinally extending from the first body; and a second member including a second body, and a second middle connection bridge and two second side connection bridges each longitudinally extending from the second body, wherein the first member and the second member are configured to slide with respect to each other while the first middle connection bridge is placed between the two second side connection bridges, and the second middle connection bridge is placed between the two first side connection bridges.

8. The pogo pin of claim 2, further comprising a second body comprising:

a second stopper protruding from the second body, and configured to prevent the spring from being separated from the second member; and a second latch protruding from the second body so that the other end of the spring is placed between the second stopper and the second latch.

9. The pogo pin of claim 1, wherein the first member including the first body, the first middle connection bridge and the two first side connection bridges is formed of a single sheet material, and the second member including the second body, the second middle connection bridge and the two second side connection bridges is formed of a single sheet material.

10. The pogo pin of claim 1, wherein the first body comprises a first body part serving as a frame of the first member, and a first stopper protruding from the first body part to prevent the spring from being separated from the first member; and the second body comprises a second body part serving as a frame of the second member, and a second stopper protruding from the second body part to prevent the spring from being separated from the second member.

11. The pogo pin of claim 10, wherein the first body further comprises a first latch protruding from the first body part so that one end of the spring is placed between the first stopper and the first latch, and the second body further comprises a second latch protruding from the second body part so that the other end of the spring is placed between the second stopper and the second latch.

12. The pogo pin of claim 1, wherein the first middle connection bridge is bent from the first body to form a step therebetween, the step having a greater thickness than the at least one first side connection bridge.

13. The pogo pin of claim 2, wherein the first member comprises:

one end including a first probe configured to contact with an external terminal; and the other end including an insertable connection portion inserted between the two rectangular cross-sectional lead parts of the second member to be brought into contact with the second member.

14. The pogo pin of claim 13, wherein the second member comprises:

one end including a second probe configured to contact with an external terminal; and the other end including the two rectangular cross-sectional lead parts which receive the insertable connection portion of the first member inserted therebetween.

15. The pogo pin of claim 14, wherein the second probe comprises a contact portion protruding from a lower end thereof.

16. The pogo pin of claim 2, wherein each of the rectangular cross-sectional lead parts of the second member comprises a latch protrusion protruding inwardly, and wherein the first member comprises:

a latch groove to be fastened to the latch protrusion and defining a space for the latch protrusion to move up and down, and a latch jaw configured to prevent the latch protrusion from being escaped from the latch groove.

17. The pogo pin of claim 16, further comprising a second stopper protruding from a body of the second member, and configured to prevent the spring from being separated from the second member.

18. The pogo pin of claim 16, wherein the first member comprises:

one end including a first probe configured to contact with an external terminal; and the other end including an insertable connection portion inserted between the two rectangular cross-sectional lead parts of the second member to be brought into contact with the second member.

19. The pogo pin of claim 18, wherein the second member is comprises:

one end including a second probe configured to contact with an external terminal; and the other end including the two rectangular cross-sectional lead parts which receive the insertable connection portion of the first member inserted therebetween.

* * * * *